US008234959B2

(12) United States Patent
Janson

(10) Patent No.: US 8,234,959 B2
(45) Date of Patent: Aug. 7, 2012

(54) TABLE SAW FENCE

(75) Inventor: John C. Janson, Plymouth, MI (US)

(73) Assignee: Robert Bosch GmbH, Stuttgart (DE)

( * ) Notice: Subject to any disclaimer, the term of this patent is extended or adjusted under 35 U.S.C. 154(b) by 541 days.

(21) Appl. No.: 12/274,149

(22) Filed: Nov. 19, 2008

(65) Prior Publication Data

US 2010/0122615 A1 May 20, 2010

(51) Int. Cl.
*B27B 27/02* (2006.01)

(52) U.S. Cl. ..... 83/438; 83/441; 83/467.1; 83/477.2

(58) Field of Classification Search ..... 83/438, 83/441, 446, 468.7, 471.3, 472, 473, 477–477.2, 83/478, 486, 486.1, 487–490, 581; 144/253.1, 144/286.1, 287, 307

See application file for complete search history.

(56) References Cited

U.S. PATENT DOCUMENTS

| | | | | |
|---|---|---|---|---|
| 2,521,302 | A * | 9/1950 | Musselman | 83/438 |
| 2,677,400 | A * | 5/1954 | Gaskell | 83/438 |
| 2,966,179 | A * | 12/1960 | Gaskell | 83/438 |
| 3,021,881 | A * | 2/1962 | Edgemond, Jr. et al. | 83/438 |
| 4,658,687 | A * | 4/1987 | Haas et al. | 83/438 |
| 4,846,036 | A * | 7/1989 | Metzger et al. | 83/438 |
| 4,848,203 | A | 7/1989 | Brooks | |
| 5,181,446 | A | 1/1993 | Theising | |
| 5,293,802 | A | 3/1994 | Shiotani et al. | |
| 6,360,641 | B1 * | 3/2002 | Talesky et al. | 83/438 |
| 7,444,913 | B2 * | 11/2008 | Shibata et al. | 83/446 |

* cited by examiner

*Primary Examiner* — Edward Landrum
(74) *Attorney, Agent, or Firm* — Maginot, Moore & Beck

(57) ABSTRACT

A table saw fence includes a clamping member at both the front and rear of the fence to provide substantial clamping power and accuracy. The fence includes an interior cavity housing a linkage mechanism that engages the front and rear clamps through the actuation of a single handle. Furthermore, the fence includes an opening leading to the interior cavity, thereby permitting the blade, riving knife, blade guard, and any other blade accessories to extend within the interior cavity when the fence is used in a blade cover configuration.

17 Claims, 5 Drawing Sheets

TABLE SAW FENCE

TECHNICAL FIELD

The present invention relates generally to power saws, and particularly to material guides or fences that accurately direct material past the cutting instrument.

BACKGROUND

The typical table saw includes a cutting instrument, usually a saw blade, attached to a motor mounted beneath a work surface, commonly called a table. The table has an opening that allows a portion of the blade to extend therethrough. To make a cut, a user places material on the table and directs the material past the rotating blade. To assist users in making accurate cuts, many table saws are adapted to receive fences.

One type of fence commonly found on table saws is the rip fence. Rip fences are table saw guides that assist users in making lengthwise cuts through material, as when cutting wood along the grain. Most rip fences traverse the table parallel to the cutting direction of the blade. In order to make cuts of varying width, a user slides the fence along the table closer or farther from the blade. To ensure an accurate cut is made the fence should be securely fastened to the table.

A clamping system is commonly used to secure the rip fence to the table. The clamping system secures the fence to a guide mounted on the edge of the table. The guide often extends perpendicularly to the cutting direction of the blade and traverses the entire width of the table. Previously known rip fence clamping systems utilize a rip fence that slides along a guide mounted on the side of the table proximal the user. When the user places the fence in the desired position he or she engages a clamp that secures the end of the fence proximal the user to the guide. These clamping arrangements adequately secure the fence to the table, but some users may find it advantageous to have an arrangement that provides additional clamping force.

In view of the foregoing, it would be advantageous to provide a rip fence for a table saw where the rip fence provides increased clamping force. It would also be advantageous if the rip fence could be easily secured to the table. Furthermore, it would be advantageous if the lip fence could be used for other purposes on the table saw other than guiding cuts made with a blade.

SUMMARY

A new table saw includes a table, blade, blade guard, and fence. The table is a planar surface with an opening extending therethrough. A cutting blade projects through the opening in the table and is connected to a motor for rotation. First and second fence guides are secured to opposite sides of the table. A fence for guiding material past the cutting blade is releasably secured to the fence guides.

The fence includes a casing, first and second clamps, and a linkage. The casing has an opening exposing an interior cavity. The interior cavity is configured to receive the portion of the blade that extends through the opening in the table. The first and second clamps are connected to the terminal ends of the casing, and are operable to selectively clamp onto or release from the first and second fence guides. The linkage extends between the first and second clamps and is operable to engage the second clamp when the first clamp becomes engaged, as well as to disengage the second clamp when the first clamp becomes disengaged.

The above described features and advantages, as well as others, will become more readily apparent to those of ordinary skill in the art by reference to the following detailed description and accompanying drawings. While it would be desirable to provide a table saw fence that provides one or more of these or other advantageous features as may be apparent to those reviewing this disclosure. The teachings disclosed herein extend to those embodiments which fall within the scope of the appended claims, regardless of whether they accomplish one or more of the above-mentioned advantages or include all of the above-mentioned features.

BRIEF DECEPTION OF THE DRAWINGS

Figure 2:
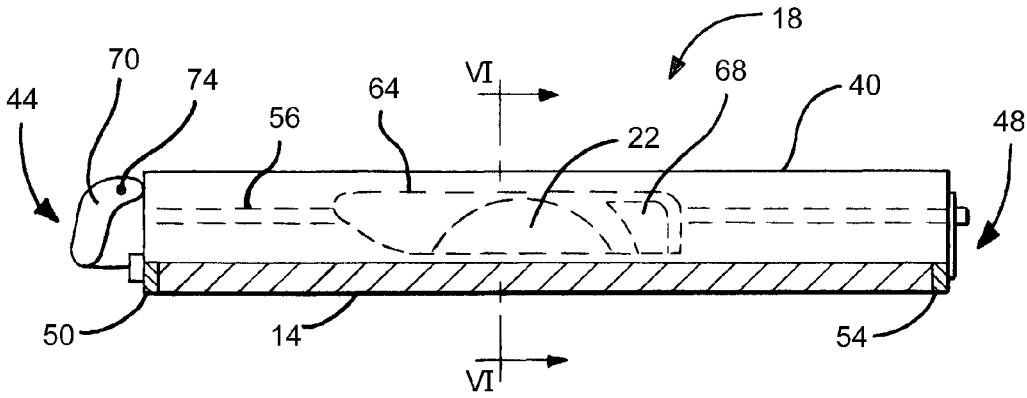
FIG. 2 depicts a side view of the table saw fence of FIG. 1 with phantom lines illustrating the internal location of the blade, the blade accessories, and a linkage arm.
Figure 3:
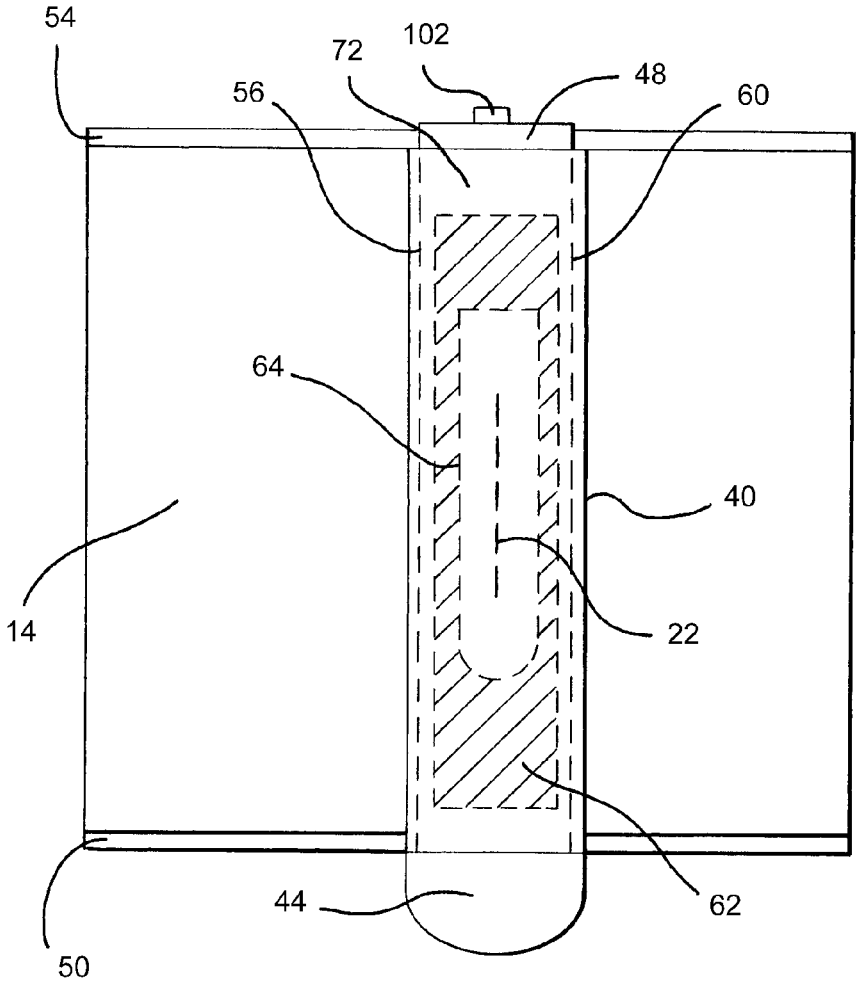

FIG. 3. depicts a top view of the table saw fence of FIG. 2 with phantom lines illustrating the internal location of the blade, the blade guard, and both linkage arms.

Figure 4:
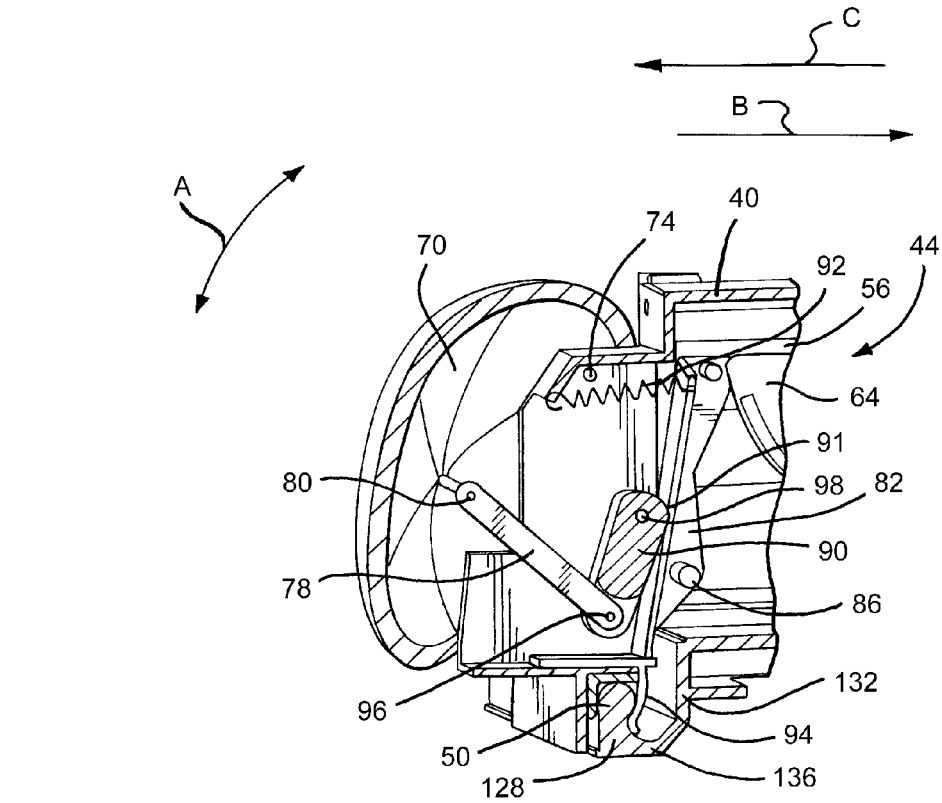

FIG. 4. depicts a cutaway view of a front clamp member of the table saw fence of FIG. 2.

Figure 1:
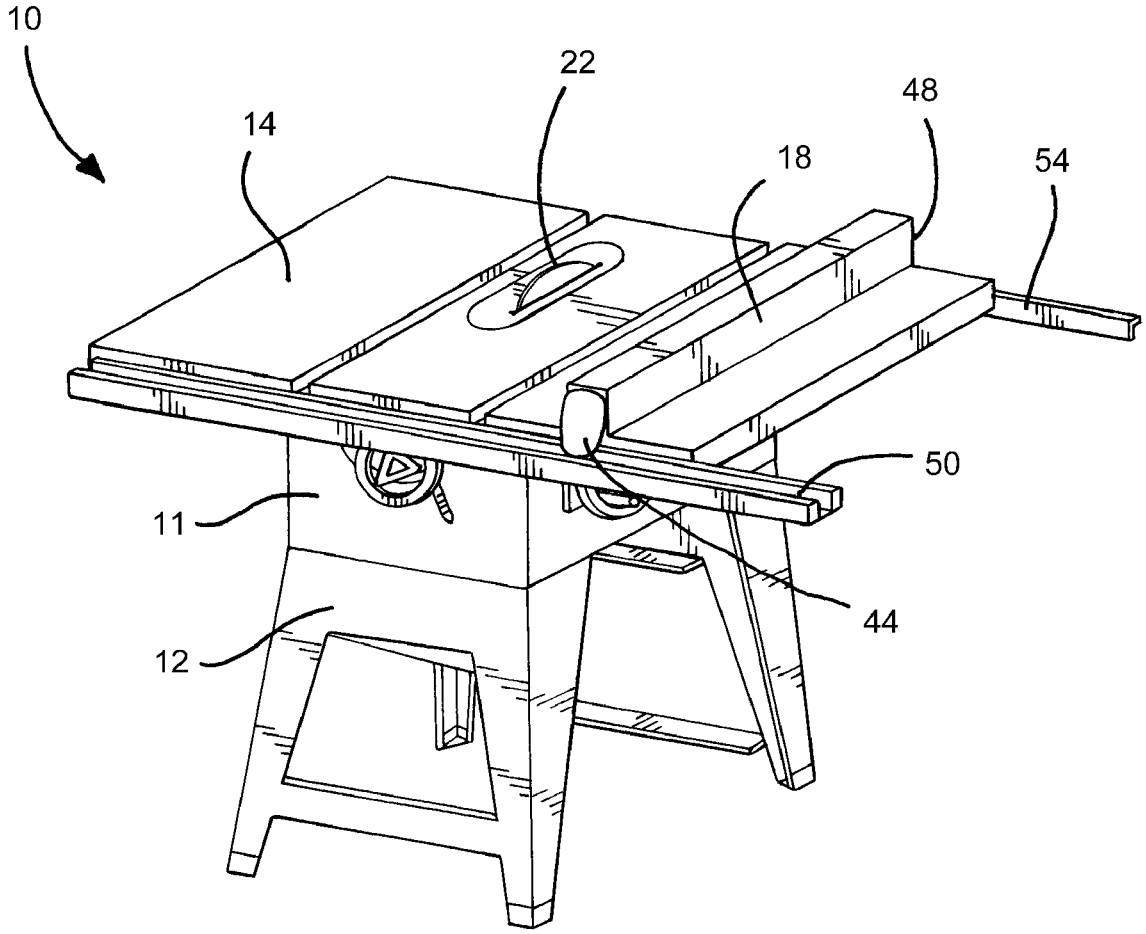
FIG. 1 depicts a perspective view of a table saw with a table saw fence.
Figure 5:
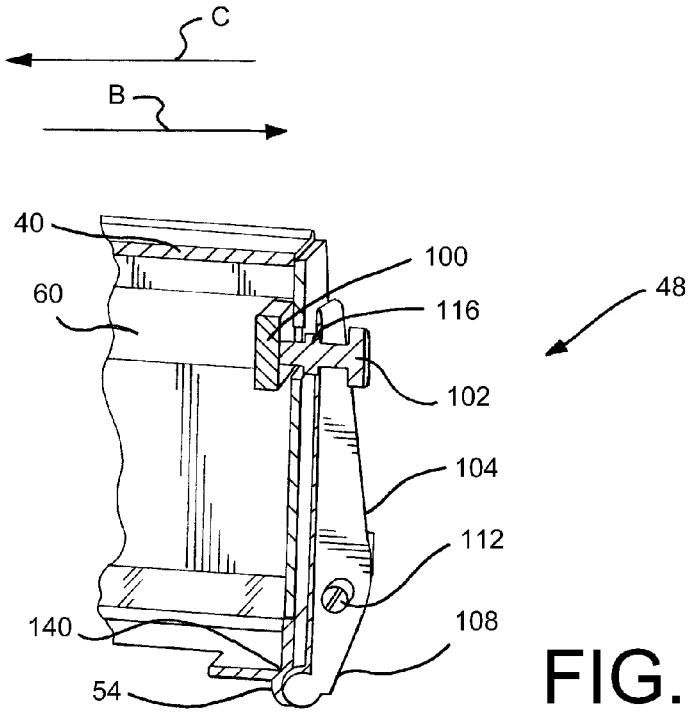

FIG. 5 depicts a cutaway view of a rear clamp member of the table saw fence of FIG. 1.

Figure 6:
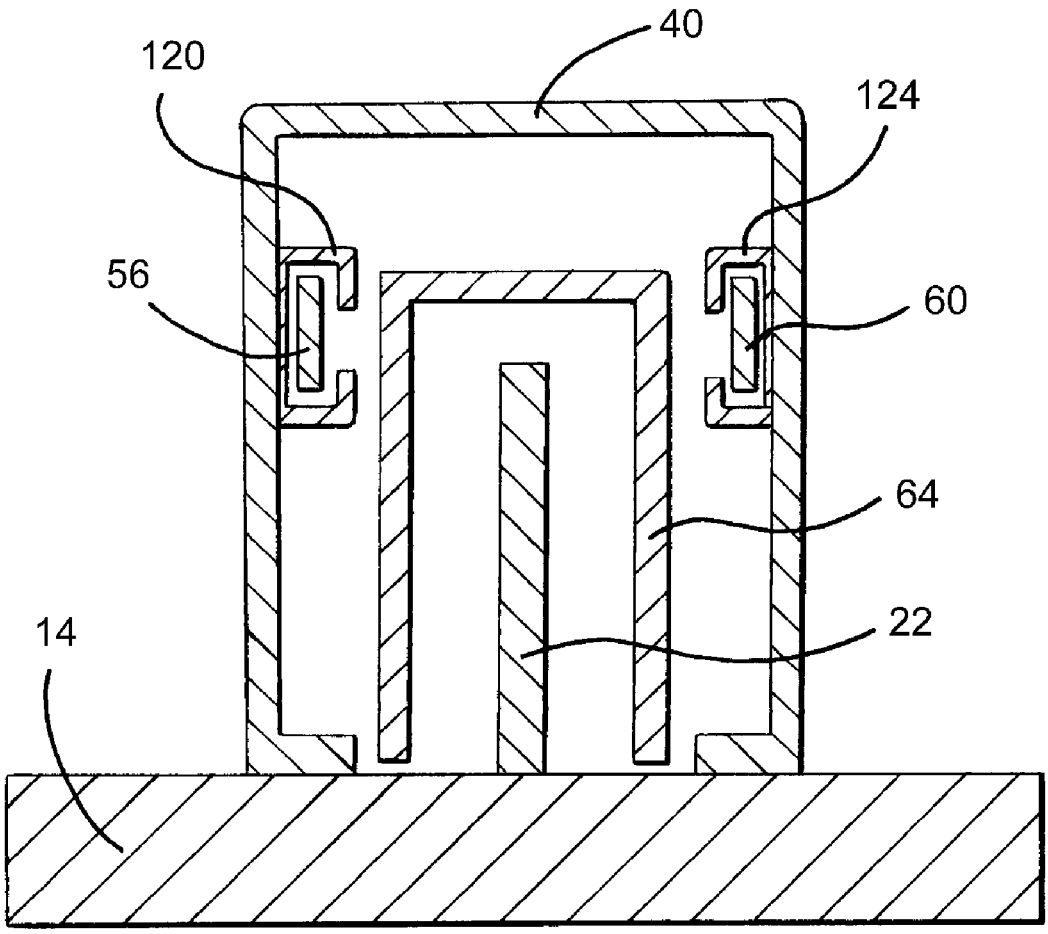

FIG. 6 depicts a cross-sectional view of the fence of FIG. 2 taken along line VI-VI.

Figure 7:
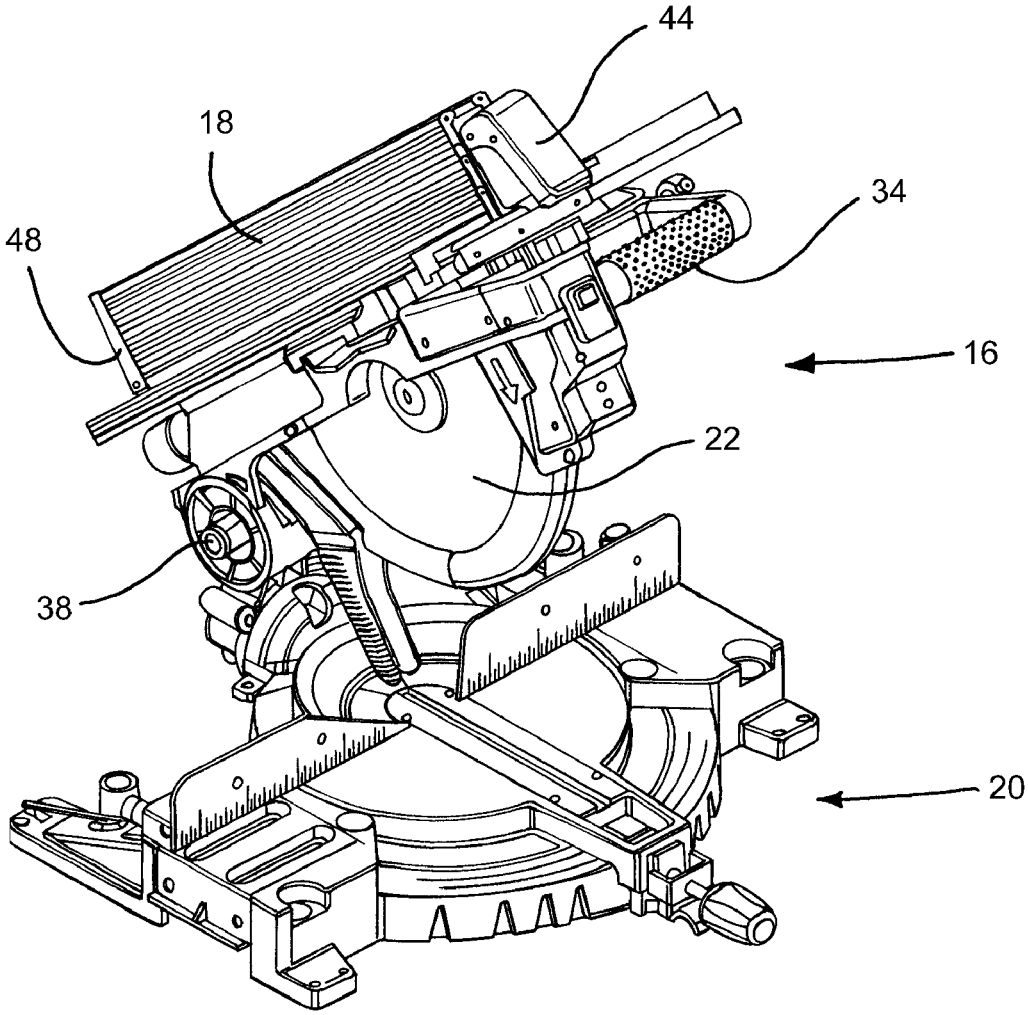

FIG. 7 depicts a perspective view of a combination table saw and miter saw incorporating an embodiment of the table saw fence.

DETAILED DESCRIPTION

FIG. 1 depicts a table saw 10 having a base 12 that supports an enclosure 11. The enclosure 11 houses an electric motor having a shaft upon which a cutting tool, usually a blade 22, is mounted for rotation. A planar surface, commonly referred to as a table 14, is secured to the top of the enclosure 11. The table 14 is usually constructed of a rigid and flat material such as metal, plastic, or fiberglass. The blade 22 projects through an opening in the surface of the table 14. Connected to, or integral with, the front and rear of the table 14 are fence guides 50, 54.

The guides 50, 54, illustrated in whole in FIGS. 1 and 3, traverse the width of the table 14 perpendicular to the cutting direction of the blade 22. The fence 18 includes lock members 44, 48 that are selectively moveable between a locked position and an unlocked position. When in the locked position, the lock members 44, 48 engage the guides 50, 54 in such a manner that the fence 18 is held in place upon the table 14. When in the unlocked position, the lock members 44, 48 disengage from the guides 50, 54 such that the fence 18 is free to slide along the table surface. The guides 50, 54 are constructed of a rigid material such as metal or plastic. The shape of the guides 50, 54 permits the fence 18 to be easily attached and removed from the table 14, and also permits the fence 18 to slide across the surface of the table 14. FIGS. 4 and 5 depict an exemplary embodiment of the shape of the guides 50, 54. In particular, the front guide 50, in the embodiment of FIG. 4, includes a channel defined by two opposing rails 128, 132 and a floor 136. Rail 132 is substantially flat and opposing rail 128 is substantially curved such that a lip is defined along the opposing rail 128. The rear guide 54, in the embodiment of FIG. 5, includes a single curved rail 140. As explained in further detail below, guide engagement members 94, 108 secure the ends of the fence 18 to the guides 50, 54.

The fence 18, as illustrated in FIGS. 2 and 3, is comprised of an elongated casing 40 with an opening 62, front and rear lock members 44, 48, and linkage arms 56, 60. Lock members 44, 48 are secured to the terminal ends of the elongated casing 40. Linkage arms 56, 60 are located within the elongated casing 40 and are connected to the lock members 44, 48. Beginning with the elongated casing 40, the construction of each of these components is explained below.

The outer surface of the elongated casing 40 forms the material guide portion of the fence 18. The casing 40 can be formed of materials including, but not limited to, extruded aluminum or other materials, sheet metal, and rigid plastics. In one embodiment, the elongated casing 40 has a rectangular shape, and each of the sides are as straight and flat as machine tolerances will allow. Additionally, the elongated casing 40 has an interior cavity 72 to allow the casing 40 to serve a cover for the blade 22 and any blade accessories.

As illustrated in FIG. 3, the surface of the casing 40 in contact with the table 14 includes an opening 62 into the interior cavity 72. The shaded portion of FIG. 3 represents the location of the opening 62 in the casing 40. The length and width of the opening 62 varies depending on the embodiment, but the opening 62 should have sufficient size to allow a blade 22, riving knife 68, blade guard 64, or any combination thereof to pass through the opening 62 and into the interior cavity 72. The length of the opening 62 should extend from at least the front and rear surfaces of the largest cutting tool or cutting tool accessory that the user may install on the saw 10. The width of the opening 62 should allow the fence 18 to slide over the blade 22 and the cutting tool accessories easily. Phantom lines in FIG. 3 demonstrate the internal location of these instruments with respect to the opening 62, with the fence 18 secured to the table 14 in the blade cover configuration. Finally, as illustrated in FIG. 2, the internal cavity 72 should have sufficient height to accommodate each cutting tool accessory a user may install on the saw 10.

In another embodiment, the opening 62 can extend across the entire bottom surface of the fence 18, such that the thickness of the fence sidewalls contact the table 14 as the user adjusts the position of the fence 18. A large opening 62 ensures that the blade accessories easily fit within the internal cavity 72.

Lock members 44, 48 are provided on the ends of the elongated casing 40. As illustrated in FIGS. 4 and 5, the lock members 44, 48 are provided in the form of clamp members 44, 48 that selectively cause the fence 18 to engage or disengage the table 14 by clamping onto or releasing from the fence guides 50, 54. Common to each clamp member 44, 48 are pivoting members 82, 104 and fence guide engagement members 94, 108. The pivoting members 82, 104 are made of a rigid material such as metal or plastic. Each pivoting member 82, 104 is connected to the clamp member 44, 48 at a pivot point 86, 112, such that the pivoting members 82, 104 pivot between a clamp position and a release position. Attached to the bottom portion of each pivoting member 82, 104 are guide engagement members 94, 108. When engaged, the guide engagement members 94, 108 provide a means of frictional contact with the guides 50, 54, but when disengaged the engagement members 94, 108 easily slide within or upon the guides 50, 54. The engagement members 94, 108 are formed of materials including, but not limited, to elastomeric materials such as natural and synthetic rubber, hard plastics, knurled metal, or any other material capable of providing frictional contact with the guides 50, 54.

FIG. 4 illustrates an example embodiment of a front clamp member 44. The front clamp member 44 includes an actuator 70, linking rods 78, 90, a front pivoting member 82, a biasing spring 92, and a front guide engagement member 94. The bottom end of the front pivoting member 82 is connected to the front guide engagement member 94, and the top end of the front pivoting member 82 is connected to the biasing spring 92 and linkage arms 56, 60. An actuator in the form of a handle 70 is connected to the clamp member 44 at pivot point 74. The first end of linking rod 78 is connected to the handle 70 at pivot point 80. The second end of linking rod 78 is connected to the first end of linking rod 90 at pivot point 96. The second end of linking rod 90 is connected to the clamp member 44 at pivot point 98, and includes a cam lobe 91 that causes the pivoting member 82 to pivot when the linking rod is rotated in the direction of arrow A. The operation of these elements when the handle 70 becomes engaged and disengaged is discussed in further detail below.

With continued reference to FIG. 4, the handle 70 becomes engaged when it is rotated in a downward direction along a handle pivot path represented by pivot path A in FIG. 4. In the engaged position, linking rods 78, 90 force the lobe 91 of the cam against the upper portion of the pivoting member 82, which causes the pivoting member 82 to rotate about the pivot point 86. When entering the "engaged" position, the top end of the pivoting member 82 and the linkage arms 56, 60 move toward the rear clamp member 48, in the direction represented by arrow B in FIG. 4, and the bottom end of the pivoting member 82 and the guide engagement member 94 move toward the handle 70, in the direction represented by a Tow C in FIG. 4.

As the handle 70 rotates downward along pivot path A, the motion of the pivoting member 82 causes the guide engagement member 94 to apply pressure to the front guide 50. This pressure ensures that the fence 18 is aligned parallel with the cutting direction of the blade 22. When the handle 70 has been fully rotated downward, the front pivoting member 82 forces the guide engagement member 94 to make a non-sliding contact with the front guide 50.

The handle 70 becomes disengaged when it is rotated in an upward direction along pivot path A, illustrated in FIG. 4. In the disengaged position, linking rods 78, 90 pivot such that the lobe 91 of the cam no longer applies pressure to the top end of the pivoting member 82. The biasing spring 92 then biases the upper portion of the pivoting member 82 in the direction of arrow C toward the release position. Specifically, the biasing spring 92 rotates the pivoting member 82 about the pivot point 86, forcing the upper portion of the pivoting member 82 toward the handle 70 along the path represented by direction C, and the lower portion of the pivoting member 82 toward the rear clamp member 48 along the path represented by direction B. In the disengaged position, the front guide engagement member 94 is completely removed from or makes a light sliding contact with the front guide 50, allowing a user to adjust the position of the fence 18. Additionally, rotation of the top end of pivoting member 82 along direction C pulls the linking arms 56, 60 toward the front of the fence 18, which disengages the rear clamp member 48.

FIG. 5 illustrates an example embodiment of the rear clamp member 48, which includes the rear pivoting member 104, a rear guide engagement member 108, an adjustment screw 102, and a linkage block 100. The rear guide engagement member 108 is connected to the bottom end of the rear pivoting member 104. The adjustment screw 102 passes through an opening in the top end of the pivoting member 104 and is threaded into the linkage block 100. The linkage block 100 spans the width of the elongated casing 40 and is connected to the linkage arms 56, 60. Interaction of these elements in both the engaged and disengaged positions is explained below.

The rear clamp member 48 does not include a handle for manual actuation; instead, linkage arms 56, 60 operate the rear clamp member 44. When the handle 70 becomes disengaged (i.e. moved upward to unlock the clamping members 44, 48) the biasing spring 92 (see FIG. 4) pulls on the top end of the front pivoting member 104 causing the linkage arms 56, 60 to move toward the front clamp member 44, in direction C, as illustrated in FIG. 5. The motion of the linkage arms 56, 60 in the direction of arrow C causes the rear pivoting member 104 to rotate about pivot point 112. Specifically, the linkage arms 56, 60 pull the upper portion of the pivoting member 104 in direction C, which causes the lower portion of the pivoting member 104 to move away from the rear guide 54 in direction B, as illustrated in FIG. 5. In the disengaged position, the rear guide engagement member 108 does not closely engage the rear guide 54 and, instead, is allowed to easily slide along the rear guide 54, permitting a user to adjust the position of the fence 18.

Alternatively, when the handle 70 is engaged (i.e., moved downward to lock the clamping members 44, 48) linkage arms 56, 60 push the top end of pivoting member 104 in direction B, which causes bottom end of the rear pivoting member 104 to move toward the rear guide 54 in direction C and closely engage the rear guide 54. In the engaged position, linkage arms 56, 60 press firmly against the top end of the rear pivoting member 104, which causes the bottom end of the rear pivoting member 104 and the rear guide engagement member 108 to press firmly against the rear guide 54, thereby securing the rear side of the fence 18 to the rear guide 54.

In order to maintain an appropriate clamping force, the rear clamp member 48 includes an adjustment screw 102, an embodiment of which is illustrated in FIG. 5. The adjustment screw 102 is threaded into the linkage block 100. The adjustment screw 102 and linkage block 100 can be made of any rigid material such as metal or plastic. The screw 102 includes a head for user adjustment and a ridge 116. Rotation of the adjustment screw 102 changes the total length of the linkage arms 56, 60 with respect to the rear pivoting member 104. For example, rotating the adjustment screw 102 counterclockwise forces the adjustment screw 102 to extend farther from the linkage block 100, along direction B, thereby lengthening the linkage apparatus and causing ridge 116 to apply pressure on the top end of the pivoting member 104. The pressure forces the bottom end of the rear pivoting member 104 and the guide engagement member 108 toward the rear guide 54. Thus, counterclockwise rotation of the screw 102 closes the gap between the rear guide 54 and the engagement member 108, allowing more of the motion provided by the linkage arms 56, 60 to function as a pressure force against the rear guide 54. Alternatively, a user can rotate the adjustment screw 102 clockwise, thereby driving the adjustment screw 102 into the linkage block 100 along direction C. The movement of the adjustment screw pulls the top end of the pivoting member 104 along direction C, which increases the gap between the rear guide engagement member 108 and the rear guide 54, effectively causing the rear guide engagement member 102 to secure the rear side of the fence 18 to the rear guide 54 with less pressure.

The linkage arms 56, 60 occupy space within the internal cavity 72, as illustrated best in FIGS. 3 and 6. The linkage arms 56, 60 extend between the first and second clamp members 44, 48. As previously mentioned, one end of each linkage arm 56 and 60 is connected to the front pivoting member 82 and an opposite end of each linkage arm 56 and 60 is connected to the linkage block 100. The linkage arms 56, 60 are constructed of a material having enough rigidity to exert sufficient pressure upon the rear clamp member 48 without bending or breaking under stress. For example, the linkage arms may be comprised of, for example, metal, plastic, and other rigid materials. The linkage arms 56, 60 are located within the elongated casing 40, and arranged in a position such that the cavity 72 has sufficient volume to accept the blade 22, the blade guard 64, the riving knife 68, and any other blade accessory installed by the user. In one embodiment, the linkage arms 56, 60 are proximate the left and right side of the elongated casing 40, thereby permitting larger cutting tool accessories to fit within the internal cavity 72 between the linkage arms. Furthermore, the size and shape of the linkage arms 56, 60 also provides additional volume in the internal cavity 72. In one embodiment, the linkage arms 56, 60 are rigid strips with a rectangular cross section, as best illustrated in FIG. 6. In another embodiment, the linkage arms 56, 60 are rigid circular rods. In operation, the linkage arms 56, 60 transfer the motion of the handle 70 to the rear clamp member 48 allowing the front and rear clamp members 44, 48 to react to the position of the handle 70 simultaneously.

In at least one embodiment, the linkage arms 56, 60 reside in channels 120, 124 formed in the sides of the casing 40, such as that illustrated in FIG. 6. The channels 120, 124 can be part of the casing 40 interior sidewalls or can be distinct units secured to the interior sidewalls. In either embodiment, the channels 120, 124 offer support for the linkage arms 56, 60 and also maintain the position of the linkage arms 56, 60 close to the sides of the elongated casing 40 so that they do not obstruct the internal cavity 72.

In the embodiments in which the casing 40 does not include linkage arm channels 120, 124, the pivoting members 82, 104 support the linkage arms 56, 60, as illustrated in FIGS. 4 and 5. In these embodiments, the sides of the linkage arms 56, 60 proximate the rear clamp member 48 are connected to the linkage block 100. The width of the linkage block 100 separates the linkage arms 56, 60 as far apart from one another as the width of the casing 40 will allow. Another linkage block (not illustrated) may be used to connect the opposite sides of the linkage arms 56, 60 to the front clamp member 44.

The fence 18 can be utilized with the table saw 10, described above, portable table saws, and other known types of saws including the dual function table saw and miter saw depicted in FIG. 7. The dual function saw includes an upper portion 16 and a lower portion 20. The upper portion 16 includes a table 14 and a fence 18. The lower portion 20 includes elements to make miter cuts in materials. A hinge member 38 joins the upper 16 and lower 20 portions, and biases the saw in the miter saw configuration, which is illustrated in FIG. 7. The upper portion 16 includes a handle 34 that, when depressed, pivots the upper portion 16 toward the lower portion such that the table 14 becomes approximately level. When secured in this configuration, the saw functions similarly to a portable table saw.

In operation, a user slides the fence 18 along the guides 50, 54 until the position of the fence 18 relative the blade 22 equals the desired cutting width. The user then engages the handle 70 to secure the clamp members 44, 48 to the guides 50, 54. In this configuration, the fence 18 offers the user a guide securely clamped to the front and rear of the table 14. In an alternative configuration, the fence 18 can serve as an additional blade cover. To utilize the fence 18 as a blade cover, the user removes the fence 18 from the table 14 and places the fence 18 over the blade 22 allowing the blade 22 and any blade accessories to enter the interior cavity 72 through the opening 62. Next, the user engages the handle 70 to secure the clamp members 44, 48 to the guides 50, 54. Thus, in the blade cover configuration the fence 18 protects the blade 22 and the blade accessories should user transport the saw 10. A user can secure the fence 18 over the blade 22 of the combination saw, as illustrated in FIG. 7, when the saw is being used in the miter saw configuration or when the user is transporting the saw.

Although a table saw fence has been described with respect to certain preferred embodiments, it will be appreciated by those of skill in the art that other implementations and adaptations are possible. Moreover, there are advantages to individual advancements described herein that may be obtained without incorporating other aspects described above. Therefore, the spirit and scope of the appended claims should not be limited to the description of the preferred embodiments contained herein, and the claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants, patentees, and others.

What is claimed is:

1. A rip fence for a table saw comprising:

a casing including an upper wall, a lower wall, a first sidewall, and a second sidewall that collectively define an interior cavity configured to receive a portion of a circular saw blade extending through a table when the casing is placed on the table, the lower wall including an opening through which the blade extends when the blade is received in the interior cavity, a first lock member provided on a first end of the casing;

a second lock member provided on a second end of the casing; and a channel structure formed in the first sidewall of the casing longitudinally extending between the first end and the second end of the casing, a linkage residing in the channel structure and operably connecting the first lock member and the second lock member, the linkage configured to move the second lock member to a locked position when the first lock member is moved to a locked position, and to move the second lock member to an unlocked position when the first lock member is moved to an unlocked position;

wherein the channel structure is spaced apart from the upper wall and the second sidewall.

2. The rip fence of claim 1 wherein the first lock member further comprises a pivoting member with first and second ends, the pivoting member configured to pivot about a pivot axis when the first lock member is moved between the locked position and the unlocked position.

3. The rip fence of claim 2 wherein the first lock member further comprises a guide fence engagement member connected to the second end of the pivoting member, the guide fence engagement member configured to slide along a channel in a guide fence when the first lock member is in the unlocked position and forcibly engage a guide fence when the first lock member is in the locked position.

4. The rip fence of claim 1 further comprising an actuator movable between a first position and a second position, wherein the first lock member and the second lock member are in the locked position when the actuator is in the first position and wherein the first lock member and the second lock member are in the unlocked position when the actuator is in the second position.

5. The rip fence of claim 4 wherein the actuator comprises a pivotable handle.

6. The rip fence of claim 1 wherein the second lock member further comprises a pivoting member with first and second ends, the pivoting member configured to pivot about a pivot axis between the locked position and the unlocked position;

a guide fence engagement member coupled to the second end of the pivoting member; and an adjustment member coupled to the first end of the pivoting member operable to adjust the position of the fence guide engagement member.

7. The fence of claim 6 wherein the adjustment member further comprises:

a linkage block joining the linkage to the first end of the pivoting member of the second lock member; and an adjustment screw engaging the linkage block, wherein rotation of the adjustment screw pivots the pivoting member of the second lock member.

8. The fence of claim 1, wherein the linkage is a first linkage and the apparatus further comprises a second linkage;

the first linkage comprises a first linkage arm with first and second ends;

the second linkage comprises a second linkage arm with first and second ends;

wherein the first end of each linkage arm is operably connected to the first lock member;

the second end of each linkage arm is operably connected to the second lock member, and the first and second linkage arms are spaced apart from each other within the casing.

9. An apparatus for cutting comprising:

a table comprising a planar surface with an opening;

a blade projecting through the opening in the table;

a first fence guide secured to one side of the table;

a second fence guide secured to an opposite side of the table; and a fence releasably secured to the table, the fence including, a casing including an upper wall, a lower wall, a first sidewall, and a second sidewall that collectively define an interior cavity configured to receive a portion of the blade, the lower wall including an opening into the interior cavity through which the blade is configured to extend when received in the interior cavity, a first clamp positioned on a first end of the casing, the first clamp configured to selectively clamp onto or release from the first fence guide, a second clamp positioned on a second end of the casing, the second clamp configured to selectively clamp onto or release from the second fence guide, a channel structure formed in the first sidewall of the casing longitudinally extending between the first end and the second end of the casing, a linkage residing in the channel structure and extending between the first clamp and the second clamp, the linkage configured to engage the second clamp such that the second clamp is clamped to the second fence guide when the first clamp is clamped to the first fence guide and such that the second clamp is released from the second fence guide when the first clamp is released from the first fence guide, wherein the channel structure is spaced apart from the upper wall and the second sidewall of the casing.

10. The apparatus of claim 9 further comprising a blade guard positioned over the blade, the blade guard being configured to fit within the interior cavity of the casing when the cavity receives the blade.

11. The apparatus of claim 9, wherein the first clamp comprises:

a pivoting member with first and second ends, the pivoting member configured to pivot about a pivot axis between a clamp position and a release position;

a biasing member connected to the first end of the pivoting member, the biasing member configured to bias the pivoting member toward the release position;

a fence guide engagement member provided on the second end of the pivoting member, the fence guide engagement member configured to engage the first fence guide when the pivoting member is in the clamp position; and an actuator movable from a first position in which the pivoting member remains in the clamp position to a second position in which the pivoting member remains in the release position.

12. The apparatus of claim 11 wherein the actuator comprises a pivotable handle.

13. The apparatus of claim 11 wherein the second clamp comprises:

a pivoting member with first and second ends, the pivoting member configured to pivot about a pivot axis between a clamp position and a release position; and a fence guide engagement member provided on the second end of the pivoting member, the fence guide engagement member configured to engage the second guide when the pivoting member is in the clamp position.

14. The apparatus of claim 13 wherein the second clamp further comprises an adjustment member coupled to the first end of the pivoting member, the adjustment member operable to adjust the force with which the fence guide engagement member of the second clamp engages the second fence guide.

15. The apparatus of claim 9, wherein the linkage is a first linkage and the apparatus further comprises a second linkage;

the first linkage comprises a first linkage arm with first and second ends;

the second linkage comprises a second linkage arm with first and second ends;

wherein the first end of each linkage arm is operably connected to the pivoting member of the first clamp; and the second end of each linkage arm is operably connected to the pivoting member of the second clamp.

16. The apparatus of claim 15, wherein the channel structure is a first channel structure and the apparatus further comprises a second channel structure formed in the second sidewall of the casing, and wherein the first and second linkage arms are supported in the casing by the first and the second channel structures, respectively.

17. The apparatus of claim 16, wherein the first and second linkage arms are spaced apart within the interior cavity of the casing by a distance greater than the width of the blade such that a portion of the blade can be positioned between the first and second linkage arms.

* * * * *